United States Patent [19]

Boss

[11] Patent Number: 4,855,882

[45] Date of Patent: Aug. 8, 1989

[54] LIGHTING APPARATUS

[75] Inventor: Ian Boss, London, England

[73] Assignee: Lightgraphix Limited, Dartford, England

[21] Appl. No.: 180,943

[22] Filed: Apr. 12, 1988

[30] Foreign Application Priority Data

Mar. 29, 1988 [GB] United Kingdom ..... 8807387

[51] Int. Cl.[4] ..... F21V 1/00

[52] U.S. Cl. ..... 362/238; 362/249; 362/226; 362/219; 439/235; 439/425

[58] Field of Search ..... 362/249, 250, 238, 240, 362/219, 223, 221, 222, 225, 145, 146, 152, 153, 226; 439/419, 424, 425, 426, 541

[56] References Cited

U.S. PATENT DOCUMENTS

| | | | |
|---|---|---|---|
| 2,506,620 | 5/1950 | Sundt | 439/425 |
| 2,800,635 | 7/1957 | Christenberg | 439/419 |
| 2,963,572 | 12/1960 | Rullo | 362/249 |
| 3,308,418 | 3/1967 | Hedstrom | 439/425 |
| 3,321,731 | 5/1967 | Goldbaum | 439/425 |
| 3,391,377 | 7/1968 | Corl et al. | 439/425 |
| 3,527,933 | 9/1970 | Thummel | 362/341 |
| 3,609,643 | 9/1971 | Connan | 439/419 |
| 4,521,839 | 6/1985 | Cook et al. | 362/238 |
| 4,654,765 | 3/1987 | Laidman | 439/235 |
| 4,655,520 | 4/1987 | Cummings | 439/426 |

FOREIGN PATENT DOCUMENTS

| | | |
|---|---|---|
| 0169165 | 7/1985 | European Pat. Off. . |
| 2327652 | 5/1977 | France . |

*Primary Examiner*—Ira S. Lazarus
*Assistant Examiner*—D. M. Cox
*Attorney, Agent, or Firm*—Klauber & Jackson

[57] ABSTRACT

The present invention provides a lighting apparatus for strip lighting on floors, walls or the like, which lies flush with the adjacent surfaces or protrudes only slightly therefrom. The lighting apparatus comprises a strip containing electrical conductors in side by side relationship. The conductors are sheathed in insulating material, and individual lighting units make electrical contact therewith in that the units, each carrying a miniature bulb have electrical conduction connector spikes which pierce the insulating sheath and contact the electrical conductors. The individual units can easily be positioned and removed. Each unit comprises a support plate and a miniature light source, and the miniature light source can readily be removed from the support plate and replaced by another. The particular construction simplfies installation and replacement of burnt out light sources.

9 Claims, 4 Drawing Sheets

LIGHTING APPARATUS

This invention relates to lighting apparatus, and in particular concerns an apparatus whereby a boundary, edge or margin may be delineated by the use of spaced illumination sources arranged in a line. The apparatus can also be used for decorative lighting purposes but again the illumination sources are arranged in a line which will usually but need not be a straight line.

In this specification the expression "strip lighting" will be used for the purposes of convenience, although this expression is used in other fields for example for space lighting where light sources such as fluorescent tubes are arranged in alignment. In the present invention however the strip lighting is not for space lighting as such insofar as the illumination sources are relatively small voltage lights, for example of the order of 24 volts, so that the strips can serve for example for delineating the nosings of stairs, aisles in theatres and cinemas where for specific reasons, the general space is maintained in darkness.

The strip lights according to the invention of course have extremely wide application and can be used in discotheques, bars and domestically, and can be sued for decorative and/or safety purposes.

The lighting apparatus to which the present invention relates is generally known in a number of embodiments, and in one embodiment a string of lights is connected in series, and the resulting string is contained in a transparent tube of plastics glass or the like to provide a rod like assembly which is simply installed in position when it is to be used. The disadvantage of this arrangement is that as the lamps are connected in series, failure of one of the lamps results in all of the lamps being extinguished. Therefore, there have been some attempts to provide a construction wherein the lamps are connected in parallel, and one such construction is disclosed in the U.S. Pat. No. 4,654,765. In the arrangement in the said patent, a channel member is provided, and in the base of the channel member is provided a strip of non-conductive material which is reflective and carries spaced conductor strips. The lamps through suitable contacts are releasably connected to the conductors on the said strip so as to be connected electrically and parallel. A cover strip which is removable closes the channel so that if any one lamp fails, the cover strip can be removed, the failed lamp removed and replaced, and then the cover strip once more placed in position.

Because of the use of the reflective non-conductive strip carrying the conductors, special connectors must be provided for the coupling together of separate lengths of the lighting apparatus and therefore installation on site is time consuming in the making of such connection and additional coupling components must be provided increasing the expense of the system.

Additionally, the methods of making electrical contact between the bulbs and the conductor strips disclosed in the said U.S. patent are complicated and/or unreliable.

The present invention seeks to provide a lighting apparatus constructed to achieve the same result as the arrangement in the said U.S. patent, but achieves this in a structurally more advantageous manner and in a manner which improves the efficiency of the apparatus.

In accordance with the invention, the lamps are connected to parallel electrical cables of the type contained in an insulating sheath in that the coupling contacts have spikes which can be made to electrically contact the cables simply by forcing the spikes through the insulating sheaths.

The advantages of this arrangement are considerable because first of all conventional sheathed electrical cables can be used and therefore regardless of the length of the strip it is not necessary to provide any special electrical connectors between lengths as is necessary in the arrangement disclosed in the said U.S. patent but rather the cables can be continuous throughout the entire length of the lighting apparatus installation.

The use of spiking contacts for coupling the lamps to the cables may be put into effect by providing for each lamp a mounting plate which is suitably of elongated rectangular form with a pair of spaced spike contacts protruding from one face thereof and at one end thereof. The said contacts may have bores therein which are open to the other face of the mounting plate so that connecting wires from the bulb can simply be pushed into said bores. At the said other side, the said plate may have a separating partition lying between the open bores to ensure that the wires from the bulb when in said bores are kept out of electrical contact, and the plate may furthermore have retention posts extending from the said other side of the plate and between which posts the envelope portion of the bulb fits to keep it in position when the bulb and mounting plate are in use.

In a complete assembly, at the location where the lighting apparatus is to be installed, a channel member for receiving the sheathed cables is placed in position, the cables are then positioned in the channel so as to lie side by side, the mounting plates with or without the bulbs can be spiked into the cables when in the channel member and if not already mounted in the plates, the bulbs can then be placed in position with the wires simply inserted into said bores and finally the channel member can be closed by means of a transparent or translucent cover to protect the lights. Electrical connection will be made to the cables in the conventional manner.

The electrical cables will be cut to the entire length of the installation and even if the strip is to be angled or curved it is simply a matter of bending the cables so that they follow the angled or curved path.

The said mounting plates may be spiked to the cables prior to installation in the channel and may be held in position by means of plastic or similar clips but as the lamps are simply installed by inserting the connecting wires thereof in the contact bores, the lamps will not be installed until the cable has been placed in position in the channel on site.

The said mounting plate preferably is of plastics material and the lamps are preferably 24 volt tungsten filament lamps whose envelopes are of torpedo shape.

An embodiment of the present invention will now be described, by way of example, with reference to the accompanying drawings, wherein.

Figure 1:
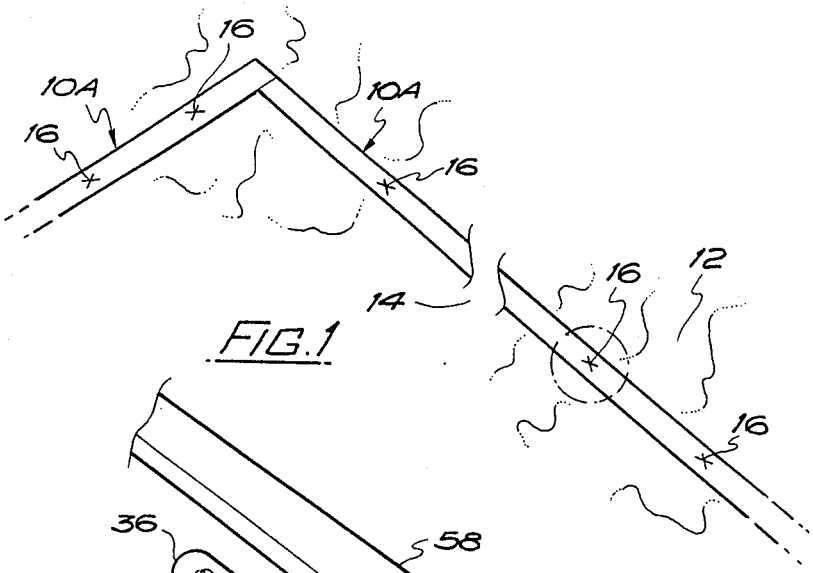
FIG. 1 is a perspective view showing the utilisation of lighting apparatus according to the invention.
Figure 2:
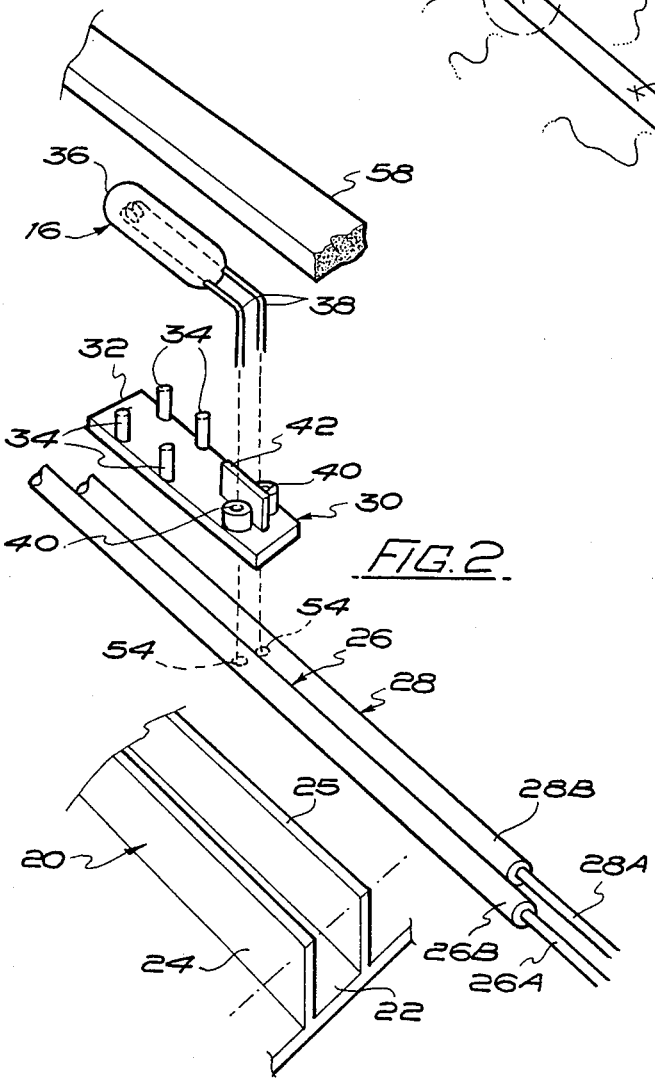
FIG. 2 shows in exploded perspective elevation a detail of the lighting apparatus which is ringed in FIG. 1.
Figure 3:
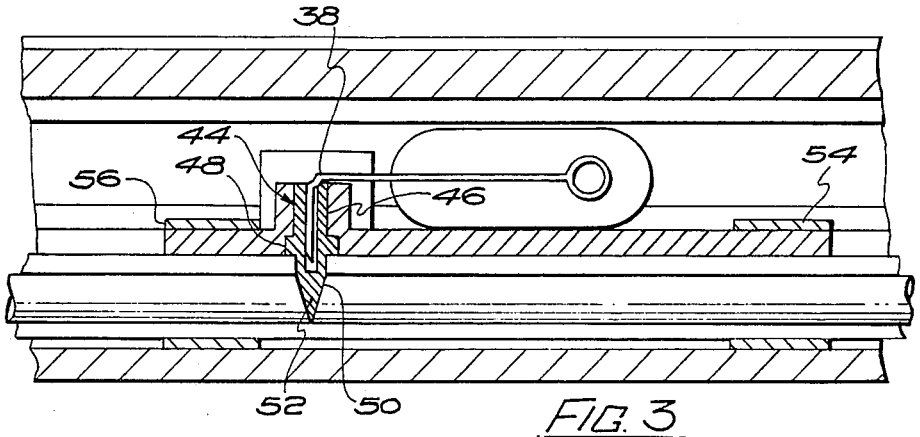
Figure 4:
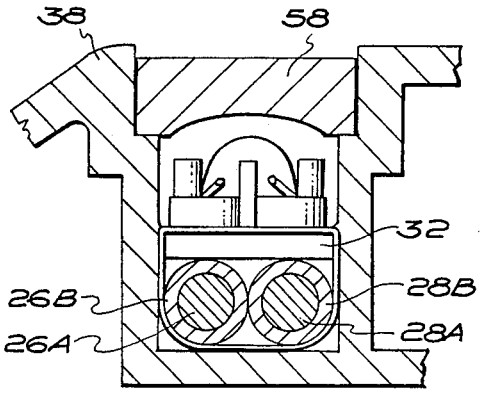
Figure 5:
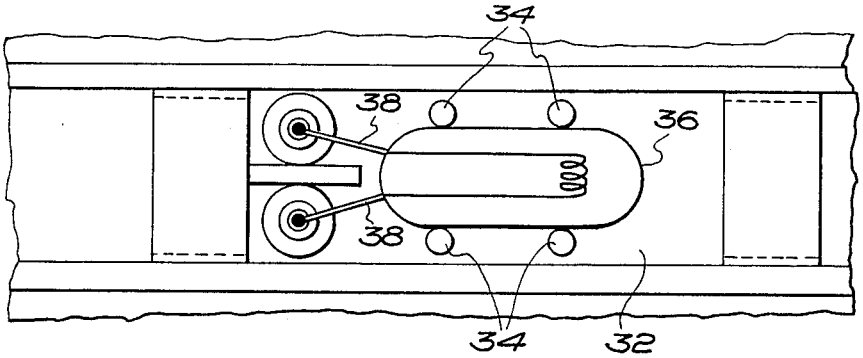
Figure 6:
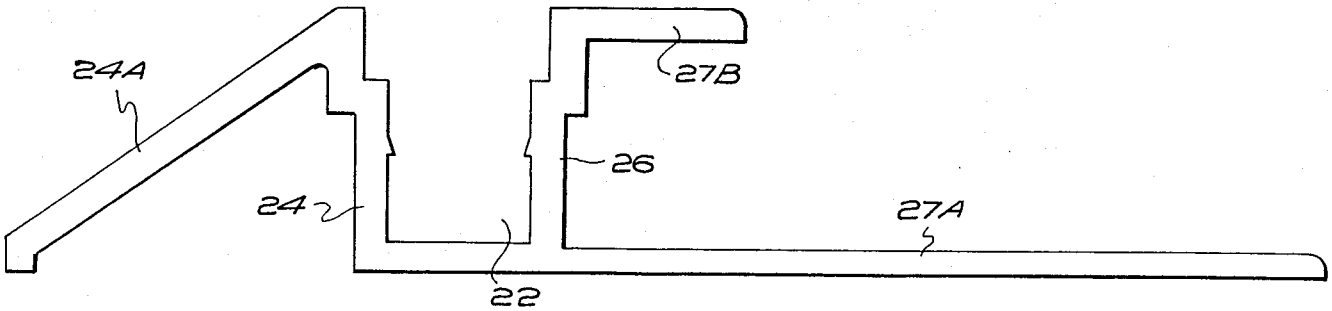

FIGS. 3, 4 and 5 are respectively a sectional side view, a sectional end view and a plan of the portion of the apparatus shown in FIG. 2, when in assembled condition; and FIGS. 6, 7, 8 and 9 show respectively different forms of channel members for holding the cables and lamps of the lighting apparatus shown in FIGS. 1 and 2.

Referring to the drawings, in FIG. 1 is shown lighting apparatus in the form of a strip assembly 10 positioned for example in a theatre aisle in order to demark the edge thereof. The strip is shown for example as being located between sections 12 and 14 of carpet, wood or other surface material and FIG. 1 also shows a section 10A of the lighting apparatus arranged at right angles to the strip 10, but illuminated in similar fashion.

The crosses 16 indicated in FIG. 1 are to indicate the positions of the light sources or lamps inside the strips 10, 10A and which are visible from above the strip. The lamps are spaced along the length of each strip 10, 10A as is shown in Fig.1, and the spacing may be as large or as small as required.

Conventionally in such an arrangement it would be common practice to connect the lamps 16 in series but this has the disadvantage that if one lamp fails, then all lamps are extinguished. Connecting the lamps in parallel of course avoids this problem, and in accordance with the embodiment of the invention as shown in FIG. 2, a particularly suitable arrangement of electrically parallel connection of the lamps is provided.

Referring to FIG. 2, each strip assembly 10, 10A is provided with a base channel member 20 which may be of extruded aluminium or the like having a base 22 and side walls 24 and 25. Into the channel fits a pair of conventional electrical cables (positive and negative) 26 and 28 which have electrical cores 26A and 28A covered by insulating sheets 26B and 28B. These cables extend for the entire length of strip 10, and also extend into and along strip 10A and any other strip in the lighting apparatus which can be connected end to end with the strips 10 and 10A, and in this connection it should be mentioned that the strips 10, 10A need not be straight but could be curved depending upon the lighting effect required.

The cables 26 and 28 simply rest in the base of the channel 20 and the lamps 16 are electrically connected thereto by means of a mounting plate 30 which comprises a base plate 32 of rectangular configuration and on one side, the top side thereof, there are posts 34 for centralising and receiving the envelope 36 of the lamp 16 to keep same in position. Electrical wires 38 of the lamp 16 fit into bores 40 in bushes carried by the plate 32 on the same side as the posts 34 and a partition 42 separates the bushes containing the bores 40 in order to keep the wires 38 spaced as will be explained. In use the wires 38 are inserted in the bores 40 and in fact although the bushes in which the bores are contained are of plastics insulating material as is the partition 42 and posts 34, centrally of each bush, as shown clearly in FIG. 3 is a metallic electrical connector pin 44 which comprises a cylindrical portion 46 contained within the bush, a shoulder portion 48 which limits the extent to which the cylindrical portion 46 can be engaged in the bush, and a spike portion 50 having a pointed end 52 the purpose of which is to pierce the appropriate cable 26, 28 as shown at 54 in FIG. 2.

The method of coupling the lamps 16 electrically to the cables 26, 28 will be readily understood in that the plate 30 is simply applied to the cables 26, 28 so that the spike portions 50 of the electrical contact metallic pins penetrate the insulating sheaths 26B and 28B and thereby make contact with electrical conductors 26A and 28A as shown in FIG. 3. The plate 30 may be thus applied whilst the lamp 16 is in position, or the lamp 16 may be applied subsequently by the insertion of the wire 38 into the bores 40, as shown more clearly in FIG. 3.

A pair of straps 54, 56 of plastics material or the like wrap round the cables 26, 28 and the ends of the plate 32 in order to hold the plate to the cables. With this construction, it is possible to apply the plates to the cables in a factory situation, and then to deliver the cables with the plates applied thereto to the site where the lighting apparatus is to be installed. The lamps 16 would then be placed in position on site.

The channel 22 is finally covered by means of a transparent cover strip 58 which may be clear or translucent and may be coloured but in any case should be such that illumination from the lamps 16 can be seen through the cover 58. The cover 58 is removable so that if any one of the lamps 16 fails, the cover can be removed the lamp 16 readily removed and replaced by a new lamp and the cover returned to its covering position.

As an alternative to applying the plates 30 to the cables 26, 28 under factory conditions, these plates can be applied to the cables on site in which case the straps 54, 56 may not be necessary.

Any suitable material can be used for the components of the installation and for example the channel 22 may be of extruded aluminium, the contact pins 44 may be of brass or other conductive metal, and the covering strip 58 and also the mounting plate 30 apart from the brass contacts may be of plastics material such as polycarbonate.

The accompanying strip 58 may be adapted to be snapped into position closing the channel 22, or it may be designed so that it is slid in from an end of the channel provided that it can be removed and access to the lamps obtained.

The shape and design of the channel will depend upon the position in which the lighting assembly is to be located. Thus, in the case of the channel section shown in FIG. 6, this channel bar is for use where the lighting is to be provided at one edge of the carpet, and to this end the leg 24 has a downwardly inclined finishing strip 24A, whilst a carpet strip 27A extends from the base of leg 26 and a short covering strip 27B provides for covering the edge of the carpet which locates between the strips 27B and 27A.

Figure 7:
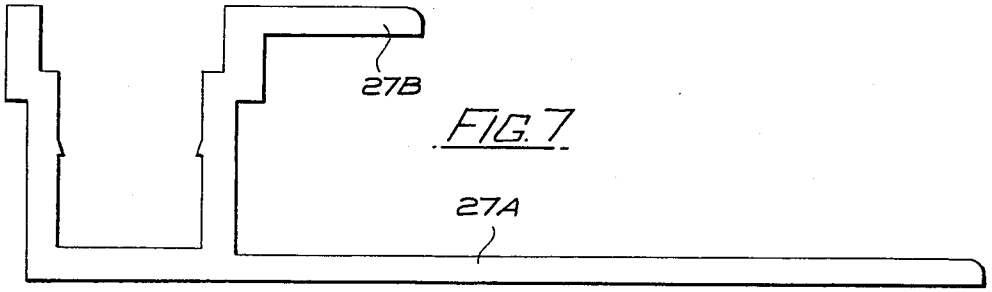

FIG. 7 shows another form of profiled bar for receiving a carpet edge at one side only, and in this case only the strips 27B and 27A are provided, the strip 24A being omitted.

Figure 8:
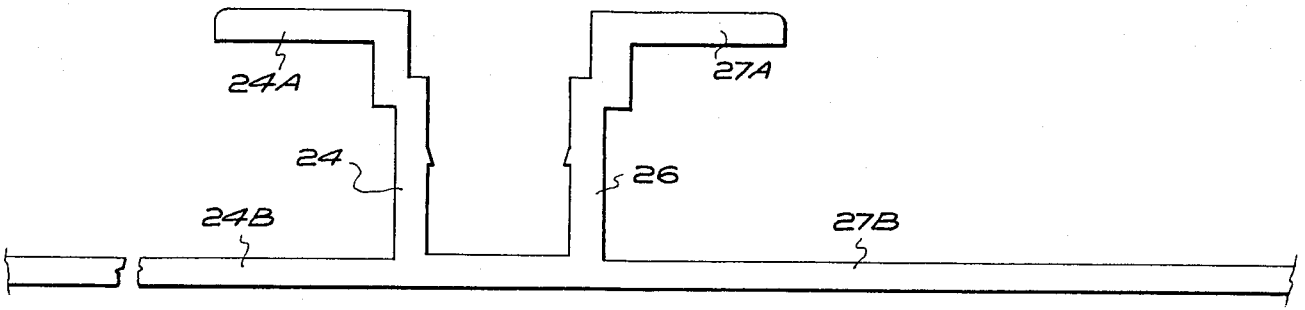

In the arrangement shown in FIG. 8, the profiled bar is for use with lighting apparatus to be located between carpet edges and therefore each of the sides 24, 26 has upper strips 24A and 27A and lower strips 27B and 24B.

Figure 9:
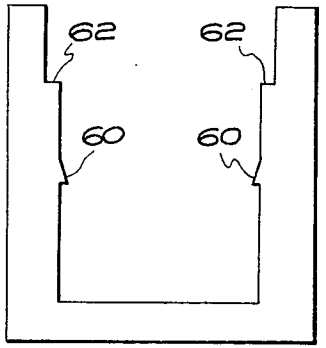

FIG. 9 shows a simple channel section which is for use where the strip is to have general application and can be positioned for example on a wall between panels of timber, marble or other materials.

It is to be noticed that in each of the cases in FIG. 6 to FIG. 9, the channel cavity is provided with locking ridges 60 passed which the plates 32 are snapped as shown in FIG. 4, and the channel section widens in the regions 62 in order to accommodate the covering strip 58 which is of the cross-section shown in FIG. 4.

What is claimed:

1. Lighting apparatus comprising a unit inserted in a channel for coupling to electrical conductors arranged in the channel side by side and covered by insulating sheath means, said unit comprising an elongate support plate adapted to be fitted to the channel with sides of the plate parallel to sides of the channel;

an illumination source supported by said support plate on one side thereof;

first and second electrical terminals connected to said illumination source; and first and second electrical connectors extending from the other side of said plate and having spike portions for penetrating the sheath means of the electrical conductors in order to make electrical contact with said conductors when the plate is inserted in the channel, said first and second terminals being electrically connected to said electrical connectors.

2. Lighting apparatus according to claim 1, wherein said first and second terminals are wire tails which are inserted in bores in said electrical connectors for the electrical connection of said illumination source to said electrical connectors.

3. Lighting apparatus according to claim 2, wherein the plate is of plastics material and at the side carrying said illumination source the plate has an integral partition maintaining the terminals physically and electrically spaced, and integral retention pins maintaining the illumination source in position on the plate, said illumination source being removable from the plate simply by lifting same clear of the pins and partition and by pulling the terminal tails from the said bores.

4. Strip lighting apparatus comprising:

(a) a channel member having a base and walls defining a channel;

(b) a plurality of illumination source assemblies in the channel member and spaced longitudinally thereof;

(c) a cover strip closing the channel member to protect said illumination source assembies;

(d) a supply of electrical power provided by first and second parallel electrical conductors in the base of the channel member;

(e) insulation covering the conductors; and (f) each of said illumination source assemblies including:

(i) an illumination source having first and second terminals;

(ii) an elongate support plate in the channel lying above the conductors and having sides parallel to the channel walls and a top side on which the illumination source is supported;

(iii) electrical connector spikes extending from an underside of the plate and spiked through said insulation to make electrical contact with said conductors; and (iv) electrical connection means for electrically coupling said first and second terminals and said electrical connector spikes.

5. Lighting apparatus according to claim 4, wherein each said plate comprises pins extending therefrom on the side supporting the illumination source for holding such source in position.

6. Lighting apparatus according to claim 4, wherein each plate comprises an upstanding partition on the side of the plate supporting the illumination source, the terminals from the illumination source being located to opposite sides of said partition, and further including apertures in the plate to opposite sides of said partition, said terminals being located in said apertures, and the apertures carrying said electrical connection means.

7. Lighting apparatus according to claim 6, wherein each illumination source, assembly forms a unit which can be applied to the first and second conductors by pressing the unit towards the conductors so that the spikes thereof penetrate the insulation and make electrical connection respectively with said first and second conductors.

8. Lighting apparatus according to claim 6 or 7, wherein said plate is of plastics material.

9. Lighting apparatus according to claim 4, wherein each illumination source comprises a small 24 volt filament light encased in a glass envelope and said first and second terminals comprise conductive wires connected to said filament and extending through the said envelope to provide tail portions which are connected to said electrical connection means.

* * * * *